US012491403B2

(12) United States Patent
Chest

(10) Patent No.: US 12,491,403 B2
(45) Date of Patent: Dec. 9, 2025

(54) EXERCISE DEVICE

(71) Applicant: Lottie Louise Chest, West Deptford, NJ (US)

(72) Inventor: Lottie Louise Chest, West Deptford, NJ (US)

( * ) Notice: Subject to any disclaimer, the term of this patent is extended or adjusted under 35 U.S.C. 154(b) by 135 days.

(21) Appl. No.: 18/378,727

(22) Filed: Oct. 11, 2023

(65) Prior Publication Data

US 2024/0115901 A1 Apr. 11, 2024

Related U.S. Application Data

(60) Provisional application No. 63/414,946, filed on Oct. 11, 2022.

(51) Int. Cl.

| | |
|---|---|
| ***A63B 21/00*** | (2006.01) |
| ***A63B 21/06*** | (2006.01) |
| ***A63B 22/14*** | (2006.01) |
| ***A63B 22/20*** | (2006.01) |

(52) U.S. Cl.

CPC ..... *A63B 21/4034* (2015.10); *A63B 21/4045* (2015.10); *A63B 22/14* (2013.01); *A63B 22/203* (2013.01); *A63B 22/205* (2013.01); *A63B 21/0618* (2013.01)

(58) Field of Classification Search

CPC ..... A63B 21/0618; A63B 21/068; A63B 21/4034; A63B 21/4045

See application file for complete search history.

(56) References Cited

U.S. PATENT DOCUMENTS

| | | | | |
|---|---|---|---|---|
| 7,938,763 | B2 * | 5/2011 | Campanaro | A63B 21/0628 482/140 |
| 8,075,457 | B2 * | 12/2011 | Campanaro | A63B 22/205 482/130 |
| 9,597,454 | B2 * | 3/2017 | Wetzel | A61M 5/31501 |
| 9,597,545 | B1 * | 3/2017 | Lagree | A63B 22/0046 |
| 10,426,991 | B2 * | 10/2019 | Barnett | A63B 21/0552 |
| 10,589,148 | B1 * | 3/2020 | Lage | A63B 22/0046 |
| 11,465,011 | B1 * | 10/2022 | Lagree | A63B 22/0089 |

* cited by examiner

*Primary Examiner* — Megan Anderson
(74) *Attorney, Agent, or Firm* — PAUL AND PAUL

(57) ABSTRACT

An exercise device includes a track unit with a generally horizontal track and a carriage device supporting a bench for receiving the torso of a user. A swivel permits rotation of the bench in a plane parallel to the track, the user propels the carriage along the track. A push-off plate is mounted perpendicular to the track positioned near the first end of the track unit for being engaged by the feet of a user. Resistance is provided by a resistance device extending between the first end of the track unit and the carriage, and/or by rotating the track unit so that the user must propel the carriage against the force of gravity.

11 Claims, 4 Drawing Sheets

EXERCISE DEVICE

CROSS REFERENCE TO RELATED APPLICATION

This application claims the benefit of U.S. Provisional Patent Application 63/414,946, filed Oct. 11, 2022, which is incorporated herein by reference.

BACKGROUND OF THE INVENTION

1. Field of the Invention

The present invention relates to exercise devices.

2. Background of the Invention

Exercise machines adapted to provide exercise to specific muscle groups are well known. Examples abound in almost every gymnasium. The present invention provides opportunities to work muscle groups frequently neglected by most specialized machines as by multi-purpose gym machines.

SUMMARY OF THE INVENTION

The present invention provides an exercise device comprising a track unit comprising a generally horizontal track, and a support device for supporting a generally horizontal member for receiving the torso of a user in a generally horizontal position. The support device includes a swivel permitting rotation of the generally horizontal member in a plane parallel to the generally horizontal track. The support device is mounted for travel along the generally horizontal track from an initial position to a final position.

The exercise device preferably includes a push-off plate mounted perpendicular to the generally horizontal track positioned proximate to a first end of the track unit, and the push-off plate is engageable by the feet of a user.

In one presently preferred embodiment, the exercise device includes a resistance device adapted to increase resistance to movement of the support device as the support device is moved from the initial position to the final position.

Preferably, the support device includes at least one pair of handles engageable by the hands of a user. Preferably, the support device includes a pair of handles extending outward towards the final position. Preferably the support device includes a pair of handles extending towards the initial position.

Preferably, the exercise device further comprises a base for mounting and supporting the horizontal track.

In another presently preferred embodiment, the generally horizontal track unit is mounted such that the angle from the horizontal can be varied. Preferably, in this embodiment, the exercise device further includes a mounting device for mounting the support device on the generally horizontal track at an angle from horizontal, such that movement from the initial position to final position is resisted by the force of gravity.

Preferably, the push-off plate includes at least one surface element for aiding a user to position the user's feet on the push-off plate.

Preferably, the position of the push-off plate is adjustable to fit the height of a user.

Preferably, the generally horizontal track comprises a pair of parallel rails.

DETAILED DESCRIPTION OF THE INVENTION

This invention provides an exercise device specifically adapted to work specific muscle groups. The device permits a user to execute a "frog kick" motion against a resistance.

Figure 1:
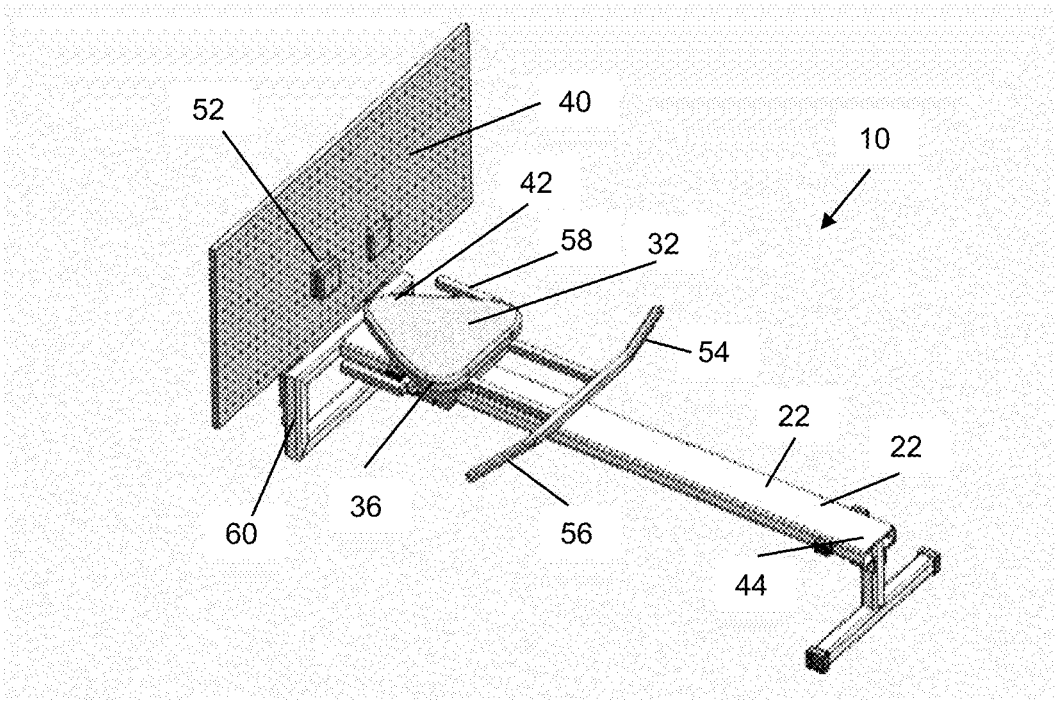
FIG. 1 is a perspective view of a first embodiment of an exercise device according to the present invention shown in a starting position with the support device shown centered above the track unit.

FIG. 1 is a perspective view of a first embodiment of an exercise device 10 according to the present invention. The exercise device 10 includes a track unit 20 comprising a generally horizontal track 22. The track unit 20 has a first end 42 and a second end 44 and is supported at a distance off the floor by a distance comfortable to a user by a base 60. A support device or carriage 30 rests atop the generally horizontal track 22 and is adapted for travel along the generally horizontal track 22 from an initial or first position 36 to a second or final position 38. A generally horizontal member or bench 32 is mounted atop the support device 30 and is adapted to receive the torso of a user, who may lie upon the generally horizontal member 32 which is preferably padded for comfort and covered with a suitable, perspiration-resistant material such as leatherette. A push-off plate 40 is preferably provided at or near the first end of the generally horizontal track 22. The push-off plate 40 preferably is mounted generally perpendicular to the generally horizontal track 22. In use, a user lays his or her torso atop the generally horizontal member 32 and pushes with his or her feet against the push-off plate 40, against the resistance of a resistance device 50 such as one or more springs, elastic exercise cords, or the like, which are fastened at one end to the track unit 30 and at the other end to the support device 20. The push-off plate 40 preferably includes at least one surface element 52 extending above the surface of the push-off plate 40 as an aid for positioning the user's feet against the push-off plate 40.

The support device 30 preferably includes a swivel 34 supporting the generally horizontal member 32 which is mounted for rotation in a plane parallel to the generally horizontal track 22, such that a user can rotate the generally horizontal member 32 through an angle either clockwise or counterclockwise as the generally horizontal member 32 is propelled by the user along the generally horizontal track 22. Preferably, the generally horizontal member 32 includes at least one pair of handles 54 for the user to grip. In particular, the generally horizontal member 32 preferably includes a pair of outwardly extending handles 56 for the user to grip with his or her hands when his or her arms are extended away from his or her torso and parallel to the generally horizontal track 22. Preferably, the generally horizontal member 32 includes a pair of inwardly extending handles 58 for the user to grip with his or her hands when his or her arms are positioned by the sides of his or her torso and parallel to the generally horizontal track 22.

Figure 2:
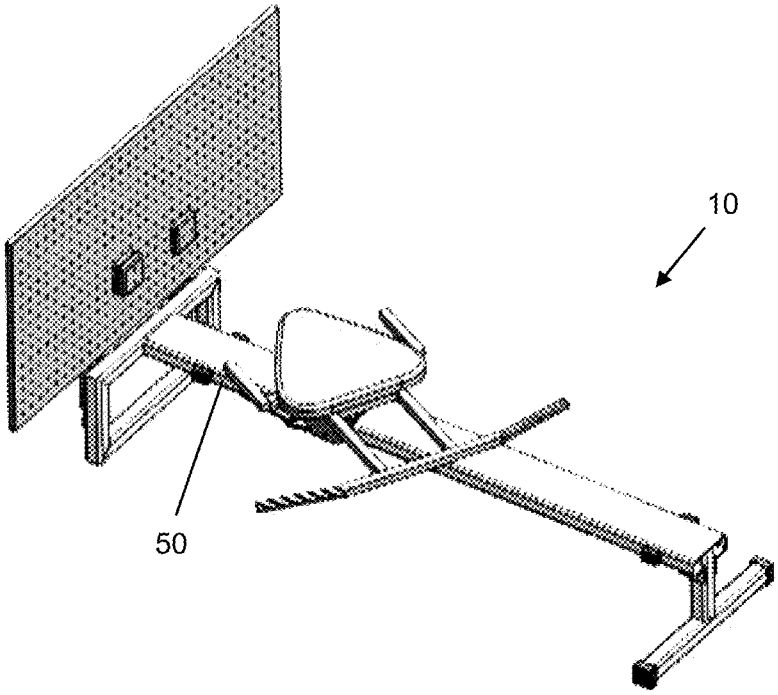
FIG. 2 is a perspective view of the exercise device of FIG. 1 shown with the support device partially advanced away from the starting position and rotated to the right.
Figure 3:
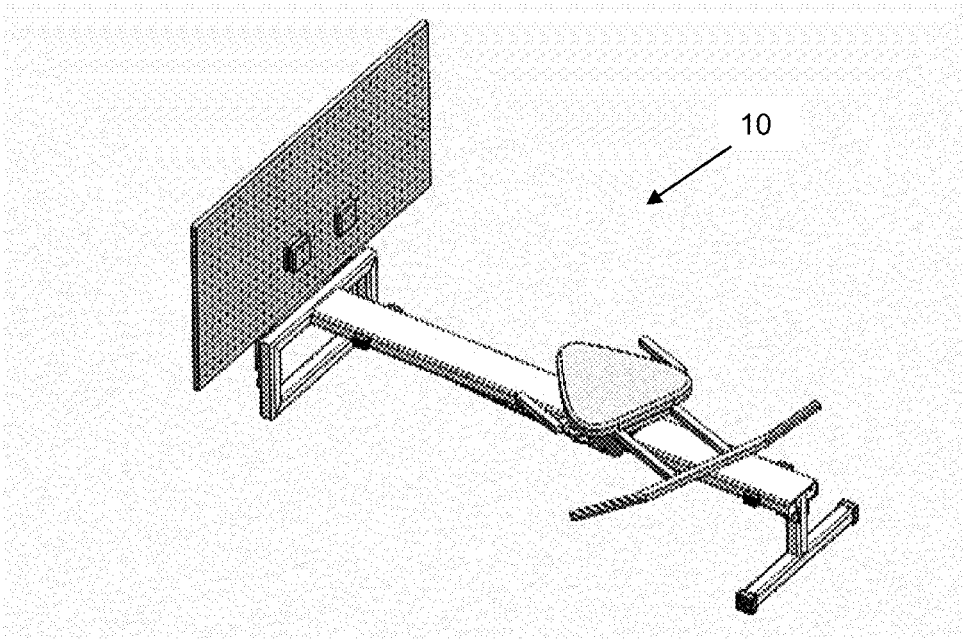
FIG. 3 is a perspective view of the exercise device of FIG. 1 shown with the support device further advanced away from the starting position and rotated to the right.
Figure 4:
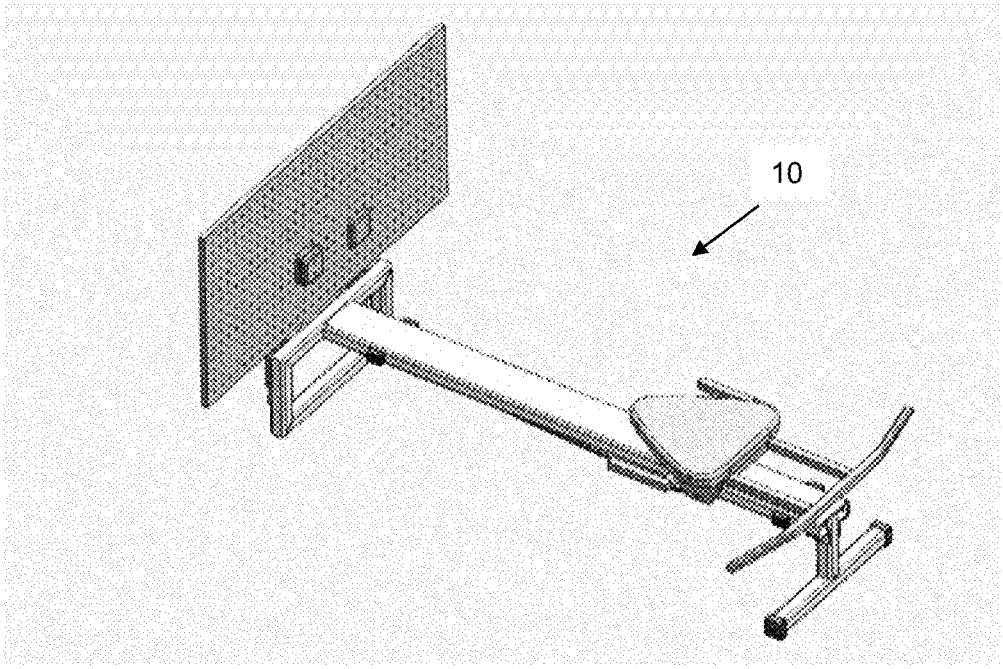
FIG. 4 is a perspective view of the exercise device of FIG. 1 shown with the support device advanced to a final position and centered above the track unit.
Figure 5:
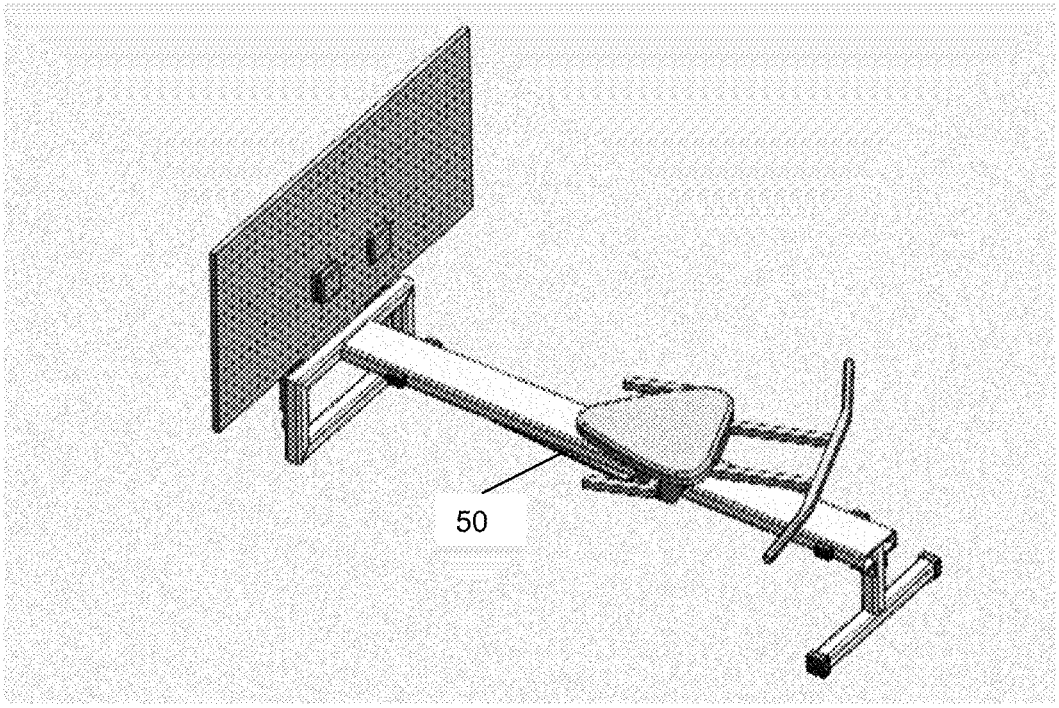
FIG. 5 is a perspective view of the exercise device of FIG. 1 shown with the support device partially advanced away from the starting position and rotated to the left.

In operation of the exercise device, a user straddles the generally horizontal member 32 and grips either the outwardly extending handles 56 or inwardly extending handles 58 and bends his or her knees and positions his or her feet against the push-off plate 40 (FIG. 1). The user then extends his or her legs thereby pushing the support device 30 forward against the resistance provided by the resistance device 50 from a first or initial position 36, while optionally swinging the generally horizontal member clockwise (FIG. 2, FIG. 3) or counterclockwise (FIG. 5) and ultimately to a fully extended, straight leg, final position 38 (FIG. 4). The support device 30 is then permitted by the user to retract back to the initial position 36, thus completing a full repetition of the exercise on the device 10.

Figure 6:
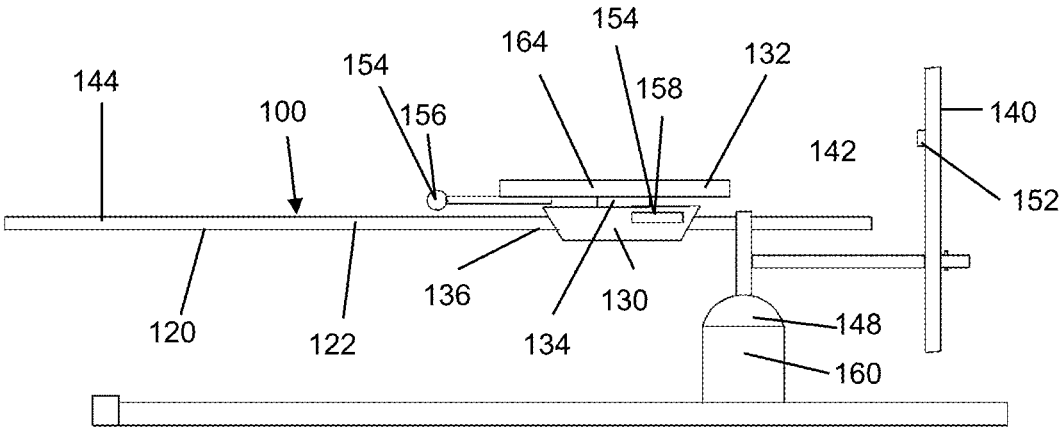
FIG. 6 is a side elevational view of a presently preferred second embodiment of the exercise device of present invention shown in a horizontal or initial position.

A second presently preferred embodiment of an exercise device 100 according to the present invention is shown in the side elevation view of FIG. 6. In this embodiment, the exercise device 100 includes a track unit 120 having a first end 142 and a second end 144. The track unit includes a generally horizontal track 122, on which is mounted on a support device or carriage 130 for travel along the generally horizontal track 122 from an initial position 136 to a final position 138. A generally horizontal member or bench 132 is mounted atop support unit 130 through a swivel 134 permitting the generally horizontal member 132 to rotate clockwise or counterclockwise in a plane parallel to the generally horizontal track 122. A push-off plate 140 is provided with at least one surface element 152 such as a block to help a user position his or her feet on the push-off plate 140. Preferably, the push-off plate 140 is supported on a rearwardly extending beam 164 at a user-variable distance fixed with a locking pin 162 or the like to permit the device 100 to be fitted to accommodate the length of the user's legs.

Preferably, the generally horizontal member 132 includes at least one pair of handles 154 for the user to grip. In particular, the generally horizontal member 132 preferably includes a pair of outwardly extending handles 156 for the user to grip with his or her hands when his or her arms are extended away from his or her torso and parallel to the generally horizontal track 122. Preferably, the generally horizontal member 132 includes a pair of inwardly extending handles 158 for the user to grip with his or her hands when his or her arms are positioned by the sides of his or her torso and parallel to the generally horizontal track 122. The outwardly extending handles 156 may include a bar for mounting conventional barbell weights to increase the resistance encountered during the exercise (not shown).

In this embodiment, the resistance to movement is provided by tilting the track unit 120 such that the user must push against the force of gravity. To this end, the exercise device 100 is provided with a base 160 fitted with a mounting device 148 permitting the user to rotate the track unit upward about a horizontal axis perpendicular to the track unit 120. The user can then mount the generally horizontal member 132, position his or her feet against the push-off plate 140 to push the generally horizontal member from an initial position 136 to a final position (not shown) while optionally rotating the generally horizontal member 132 clockwise and/or counter-clockwise.

Figure 7:
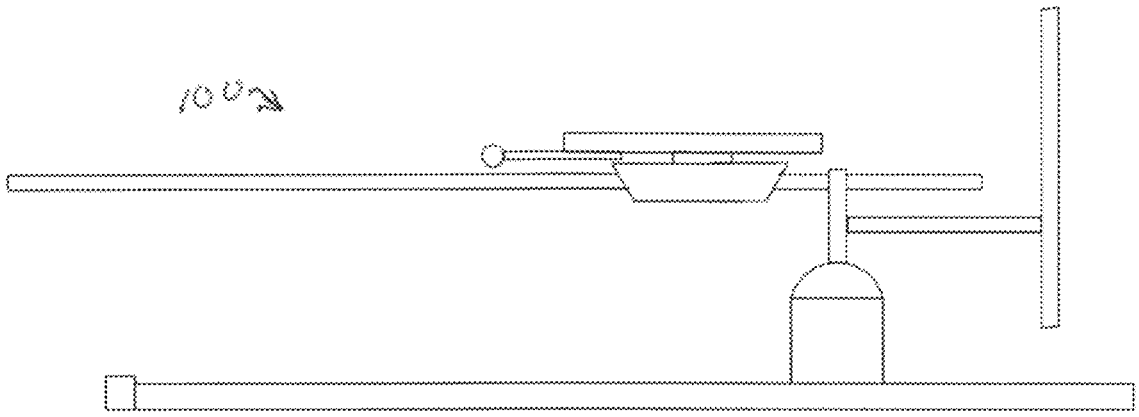
FIG. 7 is a side elevational view of the exercise device of FIG. 6 shown fitted with a resistance device.
Figure 8:
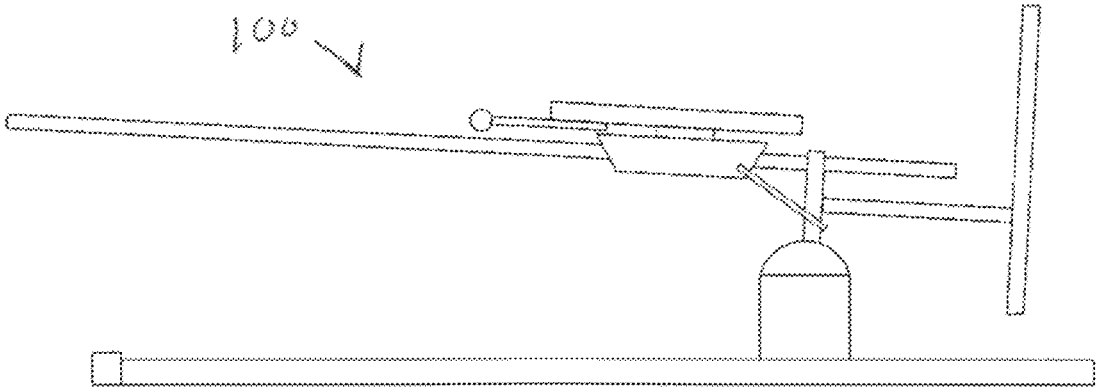
FIG. 8 is a side elevational view of the exercise device of FIG. 7 shown in a partially elevated position.
Figure 9:
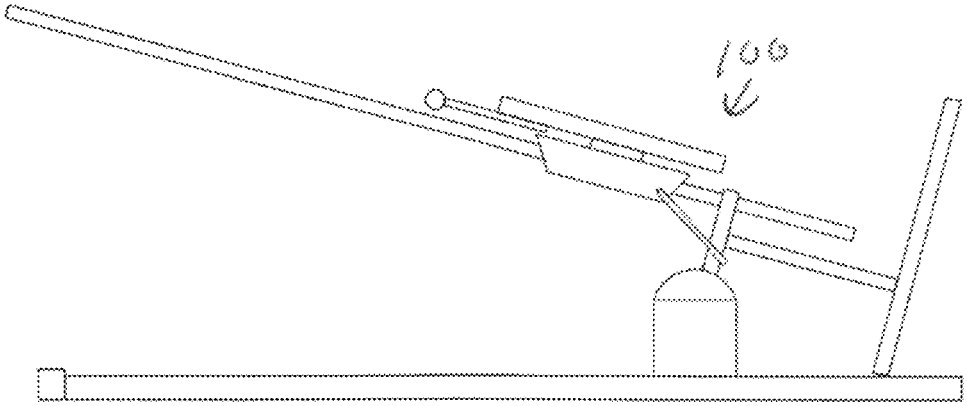
FIG. 9 is a side elevational view of the exercise device of FIG. 7 shown in a further elevated position.

FIG. 7 shows a variant of the second embodiment in which a resistance device 150 in the form of a resistance band to supplement the resistance provided by the force of gravity, while FIGS. 8 and 9 show the progressive rotational elevation of the track unit 120. Preferably, the elevation can be fixed by locking the mounting device 148 (not shown). Preferably, the track unit 120 is balanced about the fulcrum provided by the mounting device such that only a minor force is required to elevate the track unit 120, or conventional barbell or like weights can be attached to one leg of the track unit 120 to balance the track unit at least roughly for ease of use (not shown).

Various modifications can be made in the details of the various embodiments of the apparatus of the present invention, all within the scope and spirit of the invention as defined by the appended claims.

The invention claimed is:

1. An exercise device comprising:

a track unit comprising a horizontal track, a support device for supporting a horizontal member configured for receiving the torso of a user in a horizontal position, the horizontal member including a pair of outwardly extending handles adapted to be gripped by the user when the user's arms are extended away from the user's torso and a pair of inwardly extending handles adapted to be gripped by the user when the user's hands are positioned by the sides of the user's torso, the support device including a swivel, permitting rotation of the horizontal member in a plane parallel to the generally horizontal track, the support device being mounted for travel along the horizontal track from an initial position to a final position, a push-off plate mounted perpendicular to the horizontal track positioned proximate to a first end of the track unit, the push-off plate configured to be engageable by the feet of a user, and a resistance device adapted to increase resistance to movement of the support device as the support device is moved from the initial position to the final position.

2. The exercise device of claim 1, further comprising a base for mounting and supporting the horizontal track.

3. The exercise device of claim 1, wherein the horizontal track unit is mounted such that the angle from the horizontal is configured to be varied.

4. The exercise device of claim 1, wherein the push-off plate includes at least one surface element for aiding the user to position the feet of the user on the push-off plate.

5. The exercise device of claim 1, wherein the position of the push-off plate is adjustable to accommodate the length of the user's legs.

6. An exercise device comprising:

a track unit including a horizontal track, a support device including a horizontal member configured for receiving the torso of a user in a horizontal position, the support device including a swivel, permitting rotation of the horizontal member in a plane parallel to the track, the horizontal member including a pair of outwardly extending handles adapted to be gripped by the user when the user's arms are extended away from the user's torso and a pair of inwardly extending handles adapted to be gripped by the user when the user's hands are positioned by the sides of the user's torso, the support device being mounted for travel along the track from an initial position to a final position;

a push-off plate mounted perpendicular to the horizontal track positioned proximate to a first end of the track unit, the push-off plate being configured to be engaged by the feet of a user, and a mounting device for mounting the support device on the horizontal track at an angle from horizontal, such that movement from the initial position to final position is resisted by the force of gravity.

7. The exercise device of claim 6, further comprising a base for mounting and supporting the track unit.

8. The exercise device of claim 6, wherein the horizontal track is mounted such that the angle from horizontal is configured to be varied.

9. The exercise device of claim 6, wherein the push-off plate includes at least one surface element for aiding the user to position the feet of the user on the push-off plate.

10. The exercise device of claim 6, wherein the position of the push-off plate is adjustable to accommodate the length of the user's legs.

11. The exercise device of claim 6, further comprising a resistance device adapted to increase resistance to movement of the support device as the support device is moved from the initial position to the final position.

* * * * *